United States Patent [19]

Shabram, Jr.

[11] 4,183,279

[45] Jan. 15, 1980

[54] VARIABLE CHORD-FORMING CAPO

[76] Inventor: Lyle F. Shabram, Jr., 1215 Surf Ave., Pacific Grove, Calif. 93950

[21] Appl. No.: 917,932

[22] Filed: Jun. 22, 1978

[51] Int. Cl.[2] ..... G10D 3/04

[52] U.S. Cl. ..... 84/318

[58] Field of Search ..... 84/314, 315, 317, 318

[56] References Cited

U.S. PATENT DOCUMENTS

| | | | |
|---|---|---|---|
| 551,254 | 12/1895 | Brand | 84/318 |
| 2,961,913 | 11/1960 | Popkin | 84/315 |
| 3,011,380 | 12/1961 | Brimhall | 84/317 |
| 3,680,427 | 8/1972 | Valentino | 84/318 |
| 3,995,523 | 12/1976 | Clarke | 84/317 |

*Primary Examiner*—Lawrence R. Franklin

*Attorney, Agent, or Firm*—Van W. Smart

[57] ABSTRACT

Improvements in a capotasto, also known as a capo, which in its improved form is a variable cord-forming capo, for use in playing stringed musical instruments such as guitars, banjos, and mandolins. On the pin of the device are a number of pivotable clamping discs with a flattened surface on the periphery which hold selected strings against a fret, or release the same when the clamping disc is further rotated. The pin is held in place over the fret board and strings of the instrument by a side-support member fastened to a resilient strap on which there is a series of longitudinally placed eyelets. The resilient strap is placed under the neck of the instrument and holds the pin with its clamping discs above the strings by tension on the resilient strap by selection of a particular eyelet through which to pass the distal end of the pin.

5 Claims, 11 Drawing Figures

FIG. 1
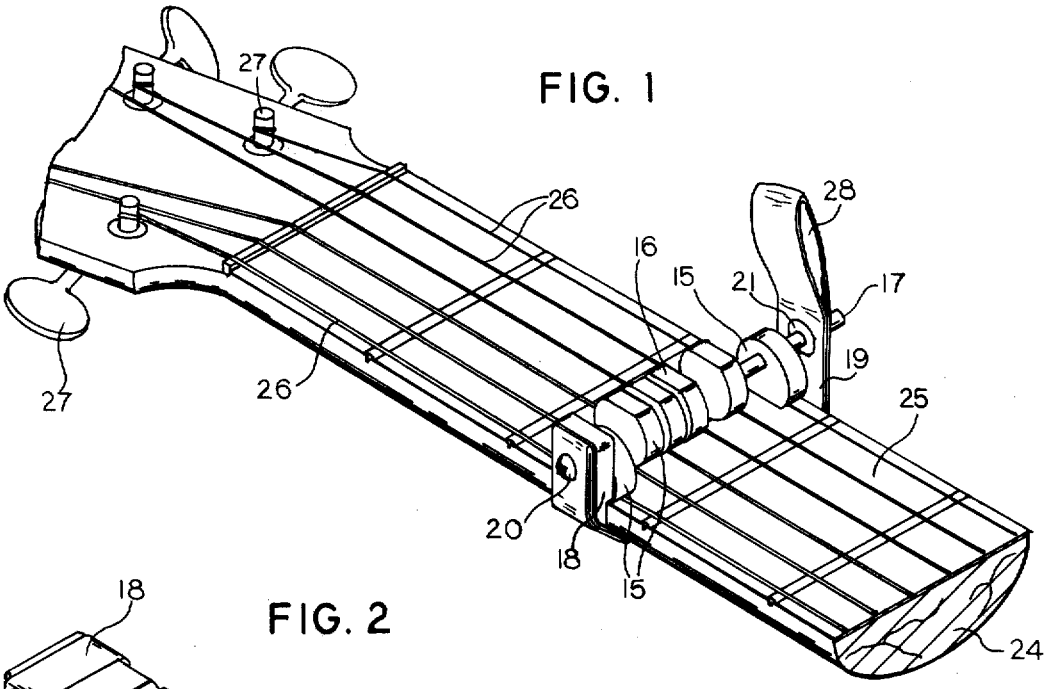
FIG. 2
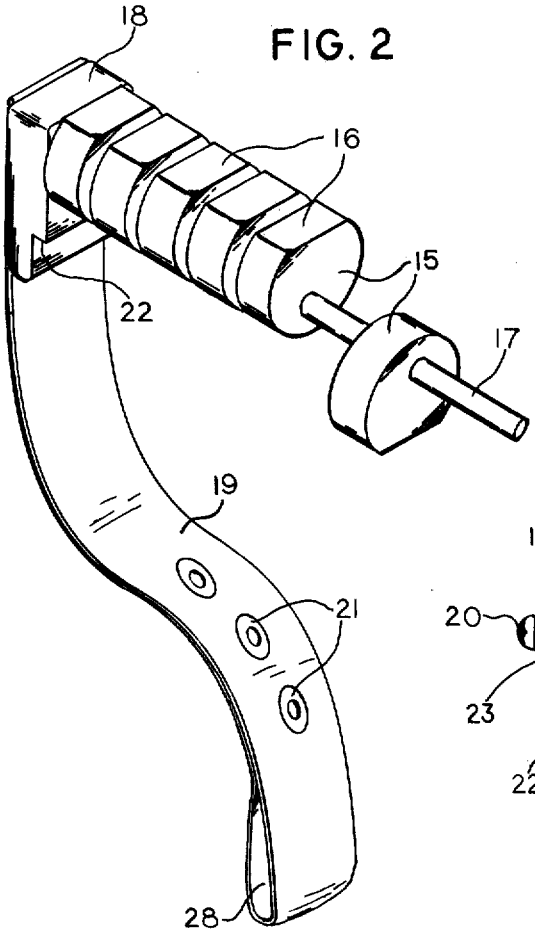
FIG. 3
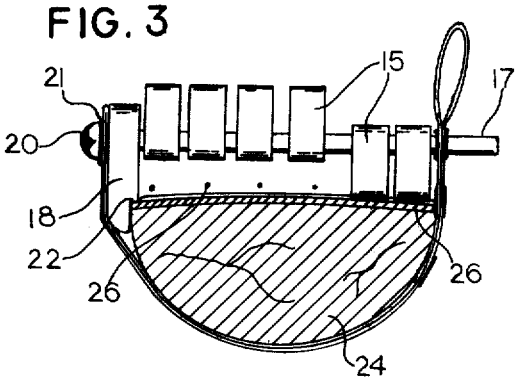
FIG. 4
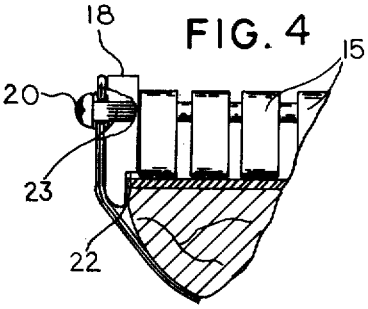
FIG. 6
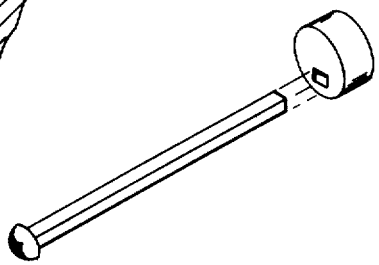
FIG. 5
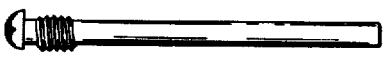
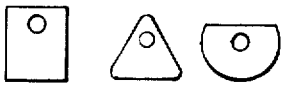
FIG. 7

VARIABLE CHORD-FORMING CAPO

BACKGROUND OF THE INVENTION (1) Field of the Invention

This invention relates to improvements in a capo. I call the improved form a variable chord-forming capo. I use it for tuning or for changing the pitch of selected strings of stringed musical instruments, such as guitars, more particularly Spanish guitars, banjos, and mandolins. These musical instruments are characterized by transversely oriented frets traversed by spaced strings that are, more or less, parallel between successive frets, though the strings may tend to converge at a point off the neck of the instrument. The strings of the guitar extend slightly above the frets, and the frets assist the player in locating the proper place for his fingers for establishing a certain musical note which he does when he presses his finger, or fingers, on strings against selected frets. The fret is a means for changing the effective length of strings; the longer the string, the lower the pitch of a note; the shorter the effective length of a string, the higher the pitch of a note.

(2) Description of the Prior Art

Prior art capos were devices attached to fretted musical instruments for the purpose of raising the pitch of all the strings at once. All of the strings were clamped at once; consequently, the pitch of all were raised at once. The prior art capos did not have the capability of clamping some strings and not the others. One consequence of this was that it would be useless, so far as musical accomplishments are concerned, to use two or more prior art capos simultaneously on a single musical instrument.

In the prior art capos there are several single-string clamping devices for use on the shorter fifth string of a five string banjo.

Many of the prior art capos were unable to function properly on both flat and curved fret boards.

Prior art tuning devices were attached to fretted stringed instruments for the purpose of raising the pitch of either one string at a time at a particular fret (U.S. Pat. No. 3,230,816 to Jira) or groups of strings at a particular fret (U.S. Pat. No. 3,680,427 to Valentino) to aid in the tuning of strings by freeing the player's chording hand.

The Jira tuning device was designed to adjust to changes in fret board width but would allow only one string to be clamped at a time.

The Valentino tuning device is designed to clamp only certain groups of strings and is used in cooperation with an attached pitch pipe. This allows more than one string to be tuned for the group of strings clamped. This tuning device has no adjustment for variations in fret board width and variations in string separation.

None of the prior art capos or tuning devices are equipped with a side-support member that allows the clamping of any one or two strings at any accessible fret.

None of the prior art capos or tuning devices allow any selected combination of strings to be clamped at any accessible fret.

The variable chord-forming capo of the present invention overcomes the aforementioned limitations and disabilities.

BRIEF DESCRIPTION OF THE DRAWING

FIG. 1 is a perspective view of the variable chord-forming capo of the instant invention mounted on the fret board of a musical instrument showing the two outer clamping discs clamping strings.

FIG. 2 is a perspective view of an unattached variable chord-forming capo of the present invention with the outer clamping disc separated from its neighbor and rotated into the down position.

FIG. 3 is a plan view of the variable chord-forming capo mounted on a curved fret board with the notched corner of the side-support member holding one end of the capo above the fret board and the two end clamping discs supporting the opposite end of the variable chord-forming capo above the fret board. The capo may be mounted with the side-support member either on the right or left side of the fret board. The neck is cut away for ease of illustration.

FIG. 4 is a fragmented, partially cut-out view of the variable chord-forming capo mounted on a flat fret board with clamping discs in the clamped or down position and the notched corner of the side-support member slightly elevated above the plane of the fret board. A section is cut-out of the side-support member to expose the position of the knurled area of the pin.

FIG. 5 is a plan view of another pin member with a threaded area to fasten the pin into a corresponding internally threaded side-support member.

FIG. 6 is an exploded view, in perspective, of an alternate means for arresting rotation of the clamping discs about the pin that preserves freedom of linear motion of clamping discs upon the pin. The stem of the pin and the eccentrically located aperture of the clamping disc have mating rectangular cross-sections.

FIG. 7 is a plan view of three of the many possible equivalents of the clamping disc 15 of FIG. 2. The basic requirement is: if the equivalents were rotated as a cam, a cam follower would produce reciprocating motion.

SUMMARY OF THE INVENTION

Figure 8:
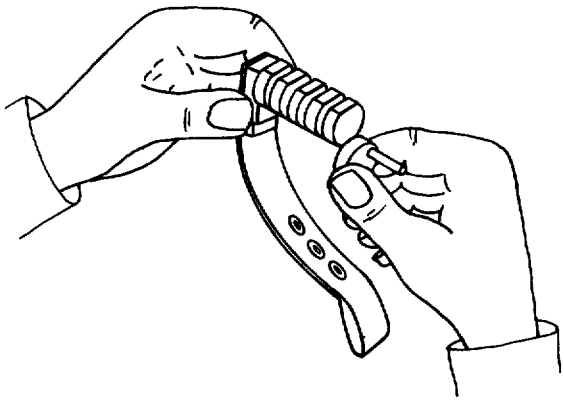
FIG. 8 shows finger manipulation of my variable chord-forming capo to achieve the positioning of FIG. 2.

An object of the present invention is to provide a variable chord-forming capo that will clamp or release all, or any number less than all of the strings, selected in any combination, at a fret for the purpose of forming a musical chord.

Another object is to provide a variable chord-forming capo that can be used in combination with a conventional capo.

Yet another object is to provide a variable chord-forming capo for controlled eccentrical rotation of individual clamping discs.

Still another object is to provide adjustable tension for holding variable chord-forming capos in fixed positions on the myriads of configurations of necks and finger boards of fretted musical instruments on sale today, including but not limited to, guitars, banjos, and mandolins.

Yet another object is to relieve the use of the player's chording hand by providing an adjustable tuning mechanism that clamps a string, or strings, at the appropriate fret to match the note, or notes, of other strings by fine tuning of the tension screws of the other strings.

Another object is to provide a means for using a plurality of variable chord-forming capos on a single instrument to expand chord formations.

Still another object of my invention is to provide adjustable spacing for clamping discs by use of the player's finger power and friction of the clamping disc on its pin. A slightly less diameter of the eccentric aperture in the clamping disc relative to the cross-section diameter of the pin that fits through the disc may be used to increase friction.

Another object of the invention is to provide a means by which uncontrolled rotation of the clamping discs about their pin is prevented by friction created by the clamping disc and pin.

Another object of my invention is to provide a variable chord-forming capo with a side-support member that allows any single string to be clamped, that aids in positioning the variable chord-forming capo on the fret board, that aids in supporting the variable chord-forming capo above the fret board, and that may be positioned on either side of the fret board.

Another object of this invention is to provide a variable chord-forming capo having rotatable clamping discs with identical flattened clamping surface on each disc. The flattened clamping surface causes each disc to remain rigidly and squarely in its clamp position and arrests its further rotation once the variable chord-forming capo is adjusted and fastened in place on a fret board. This is in preference to a curved clamping surface especially where the disc is eccentrically rotated on the pin.

Still another object of the invention is to provide a variable chord-forming capo which aids in the accomplishment of difficult chord inversions with ease.

Another object of this invention is to provide a variable chord-forming capo that will accomplish the aforementioned objects that is compact and does not obstruct the playing of any other fret than the one to which the variable chord-forming capo is attached.

As a result of the uses and advantages mentioned above the player of the guitar, or other stringed musical instrument, can perform newly available musical note combinations and chord progressions, thereby broadening the field of fret board instrument playing.

DESCRIPTION OF THE PREFERRED EMBODIMENT

Figure 9:
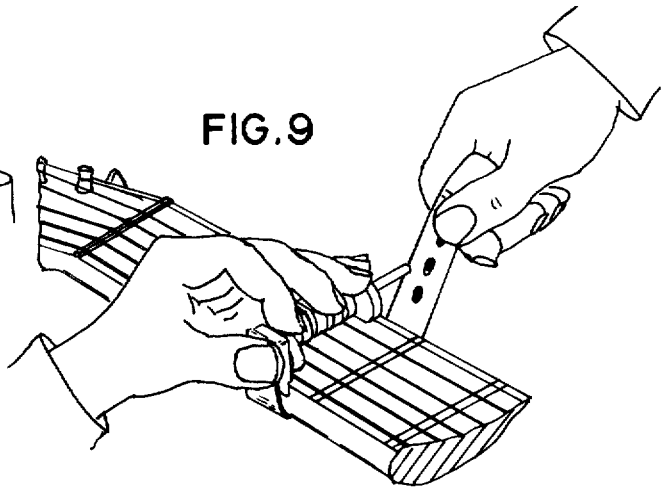
FIG. 9 shows finger manipulation of my variable chord-forming capo to achieve FIG. 1.

FIG. 2 shows a preferred embodiment of the variable chord-forming capo of my invention. It is an open-ended assembly of elements and parts of elements which are attached and cooperate together when the open ends are closed as shown in FIGS. 1, 3, and 9.

The same part of my invention appearing in more than one view of the drawing is designated by the same reference character.

The resilient strap 19 of FIG. 2 is made from a fabric-covered elastic braid of natural or synthetic rubber. The braid is a common article of commerce and widely available. It must snap back to its original length after stretching when the stretch force has been released. The purpose of the resilient strap is to permit the use of my variable chord-forming capo on a wide variety of necks and fret boards of musical instruments. I achieve a universal tight fit of my variable chord-forming capo over the necks and fret boards of musical instruments in the manner shown in FIG. 9.

A finger loop, a part of the resilient strap, is shown at 28 FIG. 2. The finger loop is of the same material as the resilient strap itself. The purpose of the finger loop is a convenience for stretching the resilient strap to get the proper tension to place the variable chord-forming capo as shown in FIG. 9 or to remove it from the musical instrument. A loop is not a necessity because a non-looped end of the resilient strap would do as well. The resilient strap is the preferred means for attaching the capo to musical instruments but other means may be used such as one of the common types of band shorteners.

On the resilient strap, just described, are a number of eyelets 21. Three are visible on FIG. 2. There is a fourth which is not visible on FIG. 2 but is shown in side view in FIG. 3. In the preferred embodiment of my invention the eyelets are identical. The operability of my invention, however, does not require identical eyelets. These eyelets are made of brass or metal of similar characteristics. The eyelets are punched into and crimped into the resilient strap either with one of the many hand-operated punches or by use of faster machine-powered devices. Gromments of suitable size may be substituted for eyelets.

My invention does not limit the number of eyelets to a particular number. There is only one terminal eyelet. It is located at 21 FIG. 3. I named this eyelet to distinguish it from the others which are located at or near the finger loop 28. I call these tension-adjusting eyelets. The purpose of the terminal eyelet is to provide connection of the resilient strap to the side-support member 18 of FIGS. 2, 3, and 4 by the head of the pin 20 FIG. 3. The purpose of the tension-adjusting eyelets is to cooperate with the distal end of the pin 17 of FIG. 2 to supply selected tension to secure my variable chord-forming capo in place over the fret board 25 of FIG. 1 and strings 26 FIGS. 1 and 3. My invention will function properly with one or two, more than the three, tension-adjusting eyelets shown, but unless the variable chord-forming capo has been custom-built for a particular musical instrument there should be at least two tension-adjusting eyelets on the resilient strap.

The side-support member 18 FIG. 2 with its notched corner 22 FIGS. 2, 3, and 4 has maximum use and purpose when only one or two strings adjacent to each other are to be clamped, and for best results, should be oriented to rest on the edge of the fret board farthest from the string, or strings, to be clamped. Many materials are suitable for constructing the side-support member. Whichever ones are selected must not split or crack when the knurled area of the pin is forced into the hole of the side-support member 18 FIG. 4. I used a pressed and cured phenolic board. It machines well and bonds satisfactorily with the knurled area 23 on the pin. Tight grained moisture-proofed wood can be used to good effect. The side-support member can be molded from several widely used thermo-setting plastics.

The use and purpose of the notched corner 22 of the side-support member 18 of FIGS. 2, 3, and 4 is to hold the variable chord-forming capo, slippage free, over the fret board of the musical instrument. Under ideal conditions of tension and alignment the surfaces of the notched corner of the side-support member lie flush with a side of the neck and the top surface of the fret board as illustrated at 22 of FIG. 3. Under other conditions of tension and alignment, the notched corner of the side-support member may displace upwards from the surface of the fret board as illustrated in 22 of FIG. 4.

There are four important functioning parts of the pin element 17 FIG. 2: the distal end, the head of the pin 20 FIG. 3, the stem of the pin, the knurled area 23 of FIG. 4. One purpose and use of the pin is to hold the clamping discs 15 as shown in FIGS. 1 and 3 above the fret boards and strings. The purpose of the stem of the pin is to provide an axis about which to pivot clamping discs to clamp and clear positions on strings. Also the purpose of the stem of the pin is to provide adjustable spacing for placement of clamping discs over strings. The purpose of the knurled area on the pin is to prevent the pin from pivoting within the side-support member. The purpose of the distal end of the pin is to furnish a means by which the clamping discs can be threaded onto the capo and be removed from the capo. The purpose of the head of the pin is to connect the resilient strap to the side-support member.

The pin used in the preferred embodiment of my invention is made of brass or a metal of similar characteristics. The stem must be of uniform diameter of such strength that it does not bend perceptibly while under tension.

FIG. 5 shows another type of pin that may be used with my variable chord-forming capo. The external threads on the stem mate with internal threads within the side-support member. FIG. 6 shows still another pin that may be used with my variable chord-forming capo. The stem of this pin has a uniform rectangular cross-section that mates into a similar rectangular hole in the side-support member.

FIG. 2, the preferred embodiment of my invention, shows five clamping discs, 15, with flattened surfaces, 16, facing upwards on the pin and the clamping disc next to the distal end of the pin facing downwards. In this illustration flattened surfaces down show a clamped string. The purpose of the clamping discs of my invention is to clamp strings in any desired order. In FIG. 2 my variable chord-forming capo is set so that one string will be clamped when it is adjusted over the fret board. Five will be unclamped. FIG. 3 shows two strings clamped to a curved fret board. FIG. 1 shows two strings clamped to a flat fret board.

Inspection of FIGS. 1, 2, 3 and 4 shows that the holes in the clamping discs are non-centric. The diameter distances from the pin to the flattened surface of the clamping discs is greater than the diameter distances from the pin to the curved surfaces of the clamping discs. Were it not for this fact the strings would be permanently clamped or permanently unclamped.

In the truncated clamping disc of FIG. 7, the hole in the clamping disc is, again, non-centric. The diameter distance from the pin to the flattened surface is shorter than the diameter distance from the pin to the curved surface of the clamping disc. A variable chord-forming capo with a clamping disc of the construction of the truncated clamping disc of FIG. 7 would clamp a string on the curved surface of the clamping disc. There is better stability of clamping when strings are clamped by flattened surfaces than by curved surfaces.

In the rectangular modification of a clamping disc and the triangular modification of a clamping disc shown in FIG. 7 we have the same conditions of non-centricity and differences of pin to surface distances on rotation of the clamping disc equivalents.

I employ an extrusion process in making my clamping discs to obtain a disc somewhat in the range of Shore A durometer 50 to Shore A durometer 70. They may be molded rather than extruded. Clamping discs in these durometer ranges have enough friction with the pin so that it takes a conscious pressure from the player's finger to rotate the clamping disc or to change position of a clamping disc along the stem of the pin. Free-pivoting of the clamping discs about the pin and free-linear displacement of a clamping disc along the stem of the pin are to be avoided. The durometer of the clamping discs and the relative diameters of the hole in the clamping discs and the pin are the dominant factors in achieving the proper compromise between a too stiff action for pivoting and linear displacement and uncontrolled pivoting and linear displacement. The variable chord-forming capo, when attached to a stringed instrument as illustrated in FIG. 1 and FIG. 9, can be used to form a musical chord, or part of some other chord usually in accordance with the key in which the music is to be played. New formations of chords and chord progressions can be developed for the instrument and scales and melodies can be played in combination with the chord formed. Using one or more variable chord-forming capos on a guitar in accompaniment with another guitar can enrich the arrangement of music.

Referring to FIG. 8, one or more strings of the variable chord-forming capo may be clamped at any accessible fret in any pre-determined combination. This may be done by adjusting clamping discs 15 FIG. 1 to the desired fret width and pivoting each clamping disc to clamp or clear positions as determined by which strings are to be clamped.

Figure 10:
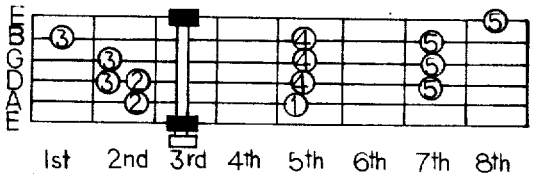
FIG. 10 is a schematic illustrating how one variable chord-forming capo on a stringed instrument may be played. Darkened blocks indicate clamped strings. Undarkened block indicates side-support positioning. Circled numbers indicate finger positions for some of the various chord possibilities where circles of the same number form the chord. The ordinal numbers at the bottom of the figure refer to frets. The capital letters at the side refer to unfretted string designations.

FIG. 10 is an example of how one capo on a stringed instrument may be played. Darkened blocks indicate clamped string. Circled numbers indicate finger positions for some of the various chord possibilities. Circles of the same number form the chord. The ordinal numbers at the bottom refer to frets. The capital letters at the left side refer to unclamped string designations.

Figure 11:
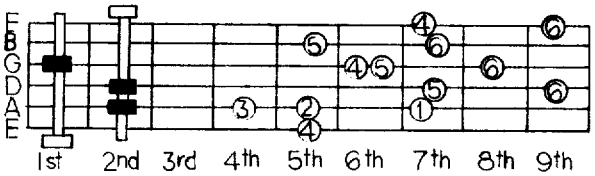
FIG. 11 is an example of play with two variable chord-forming capos of this invention in place simultaneously on the same stringed instrument. The darkened blocks, undarkened blocks, circles, ordinal numbers, and capital letters have the same significance as immediately above.

FIG. 11 is an example of play with two variable chord-forming capos attached to the same fret board. The numbered circles, ordinal numerals and capital letters have the same significance as immediately above.

With the variable chord-forming capos attached as shown in FIG. 11 where the unclamped strings are tuned as indicated (standard tuning), playing the strings in succession (from bottom to top) produces the chord E, B, E, G#, B.E. This is the chord formed by the variable chord-forming capos. This chord may be easily played by a guitarist.

Altering the second note by fretting the position indicated by the circled number 3 produces the chord E, C#, E, G#, B, E. This is a somewhat more difficult chord when played without the variable chord-forming capos attached.

Fretting the positions indicated by the circled numbers 4 produces the chord A, B, E, C#, B, B where the three B notes are in succession separated by octaves. This is an example of a chord inversion or combination of notes that would be impossible to achieve without the assistance of a fretting device or changing the tuning.

Although changes in the tunings of strings would allow this chord inversion to be achieved, there is a limit to which the tension of any string may be tuned, and, therefore, there is always some chord which is impossible for the particular tuning that could be achieved with the aid of the variable chord-forming capos of this invention.

As a tuning device the variable chord-forming capo may be used as follows: a single string (with the aid of the side-support) is clamped at the appropriate fret so that the tension of another string may be adjusted by the tuning mechanism 27 FIG. 1 until the pitch of the unclamped string matches the pitch of the clamped string. For example, clamp the fifth fret of the first, or E, string and match the pitch of the open second, or A, string, or clamp the tenth fret of the first, or E, string, to match the pitch of the open third string, or D, string. In particular cases groups of strings may be clamped so that more than one string may be tuned without readjusting the variable chord-forming capo. For example, if the first and third strings are correctly tuned, clamp the fifth fret of these strings and match the pitch of the second and fourth open strings.

The variable chord-forming capo of this invention has within its structure a seven-part means for securely fitting it over the fret board and strings of the multiformed stringed instruments encountered in use today.

Part one of the seven part universal fitting means is the resilient strap 19. Part two of the seven part universal fitting means is one of the several tension-adjusting eyelets 21. Part three of the universal fitting means is the head of the pin 20. Part four of the seven part universal fitting means is the notched corner 22 of the side-support member 18. Part five of the seven part universal fitting means is the stationary stem of pin 17. Part six of the seven part universal fitting means are the finger pressure responsive clamping discs 15 for pivoting and linear displacement on stationary pin 17. Part seven of the seven part universal fitting means is the distal end of stationary pin 17 for engagement with the tension-adjusting eyelet.

Universal fitting is accomplished as follows: place the notched corner of the side-support member 18 on the face of the fret board with the notch of the notched corner against the side of the neck of the instrument, then adjust the clamping discs 15 along the pin 17 so as to cover each string, next put a remote (from the side-support member) clamping disc 15 into the clamping position, then run the resilient strap 19 down the side of the neck 24 of the instrument adjacent to the side-support member, then under the neck of the instrument, then pull the resilient strap to put tension on it, finally keep the desired tension by selecting the proper tension-adjusting eyelet 21 to insert the distal end of the pin. Having followed these directions, my variable chord-forming capo will not loosen, move, or shift while the instrument is being played.

When my variable chord-forming capo is under tension in playing position above the fret board of an instrument, it has a dynamic stress control means that assists in prevention slipping out of the playing position. In these conditions the notched corner 22 is tight against the side of the neck 24 of the musical instrument.

As the vectors of tension forces change, the notched corner 22 and side of the neck of the instrument are bearing surfaces upon which the side-support member 18 may slide upwards from the top surface of the fret board and downwards to the top surface of the fret board to establish new force equilibriums.

When the variable chord-forming capo of my invention is in position as illustrated by FIGS. 1 and 3, the combination of the clamping discs 15, their flattened surfaces 16, and non-rotating pin 17, are the three part eccentric means for clamping, releasing, and clearing strings 26.

As illustrated in FIG. 3, the head of the pin 20 is the articulating means for attaching resilient strap 19 through the latter's terminal eyelet 21 to the side-support member 18 and non-rotating pin 17.

The Shore A range of elasticity, in the broad range of about 50 to about 70, of the clamping discs 15 and the differential of the uniform diameters of the non-centric holes of the clamping discs and the cross-section diameter of the pin are a finger pressure responsive friction means for stabilizing eccentric pivoting and linear spacing of clamping discs on the stem of the pin 17.

When the variable chord-forming capo of this invention is used as a tuning device it must be used in cooperation with the tuning mechanism 27 FIG. 1 of the musical instrument.

I claim:

1. An open-ended variable chord-forming capo for use in tuning, and playing note combinations, chord progressions and chord inversions on stringed musical instruments which comprises in combination:

(a) a resilient strap comprising:
  (1) a finger loop,
  (2) a terminal eyelet,
  (3) a plurality of tension adjusting eyelets;
(b) a side support member comprising:
  (1) a notched corner, and having
  (2) a pin receiving hole;
(c) a pin comprising:
  (1) a head,
  (2) a knurled area adjacent to the head;
  (3) a stem of uniform cross-sectioned diameter;
(d) a plurality of identical elastic finger responsive elastic clamping discs each having:
  (1) identical peripheral flattened surfaces,
  (2) identical non-centric pin receiving holes, wherein the diameter distance from the holes to the flattened surfaces is longer than the diameter distances from the holes to the curved surfaces;
(e) with the elements and parts of the combination being interrelated as follows:
  (1) the resilient strap is rotatably connected to the unnotched side of the side-support member by the head of the pin; also, the resilient strap is connected at its terminal eyelet by the head of the pin, also, the resilient strap is indirectly connected to the clamping discs by the stationary stem of the pin that connects with the side-support member by the knurled area on the pin;
  (2) the side-support member indirectly connects the clamping discs by means of the stationary pin through the side-support member's pin receiving hole;

(3) the pin is directly connected to the clamping discs by passing through the clamping disc's non-centric pin receiving holes.

2. A variable chord-forming capo for use on stringed musical instruments which comprises in combination:

(a) a resilient strap comprising:
(1) a finger loop,
(2) a terminal eyelet,
(3) a plurality of tension-adjusting eyelets;

(b) a side-support member comprising:
(1) a notched corner, and having
(2) a pin receiving hole;

(c) a pin comprising:
(1) a head,
(2) a knurled area adjacent to the head,
(3) a stem of uniform cross-section diameter;

(d) a plurality of identical elastic finger responsive elastic clamping discs each having:
(1) identical flattened surfaces,
(2) identical non-centric pin receiving holes, wherein the diameter distance from the holes to the flattened surfaces is longer than the diameter distances from the holes to the curved surfaces;

(e) a seven part universal fitting means for securely positioning the variable chord-forming capo in playing position over multiformed necks and fret boards;

(f) a dynamic stress control and force equilibrium establishing means for preventing slippage of position of the variable chord-forming capo while being played;

(g) a finger pressure responsive friction means for establishing the pivoting and linear spacing of clamping discs on the stem of the pin;

(h) with the elements and parts of the combination being interrelated as follows:
(1) the resilient strap is rotatably connected to the unnotched side of the side-support member by the head of the pin; also, the resilient strap is connected at its terminal eyelet by the head of the pin, also, the resilient strap is indirectly connected to the clamping discs by the stationary stem of the pin that connects with the side-support member by the knurled area on the pin;
(2) the side-support member indirectly connects the clamping discs by means of the stationary pin through the side-support member's pin receiving hole;
(3) the pin is directly connected to the clamping discs by passing through the clamping disc's non-centric pin receiving holes.

3. Two or more variable chord-forming capos according to claim 2, simultaneously attached above different frets of a single conventional fret board musical instrument.

4. The subcombination of elements and parts in an open-ended chord-forming capo comprising:

(a) side-support member having:
(1) a pin receiving hole,
(2) a notched corner;

(b) a pin having:
(1) a head,
(2) a knurled area adjacent to the head,
(3) a stem of uniform cross-section diameter;

(c) a plurality of identical elastic finger pressure responsive clamping discs each having:
(1) an identical flattened surface on the edge,
(2) identical non-centric pin receiving holes, wherein the diameter distance from the holes to the flattened surfaces is longer than the diameter distance from the holes to the curved surfaces;

(d) a three part side-support pin-clamping disc means for setting the clamping discs at proper height above the fret board and strings for the clamping and releasing of strings, wherein the notched corner of the side-support member when set flush with top of the fret board and the side of the neck of the instrument forms one support for pin height above the fret board and the clamping discs of clamped strings, the other height support;

(e) finger pressure responsive friction means for pivoting clamping discs about the pin and linearly spacing clamping discs upon the pin;

(f) means for mounting the capo on the neck of a stringed musical instrument.

5. A variable chord-forming capo comprising in combination:

(a) a universal fitting means for fastening the variable chord-forming capo on all sizes and shapes of necks of fret board musical instruments, (b) a uniform cross-sectioned pin fastened at its head to (c) a resilient strap, also, fastened at its head to (d) a side-support member positioned over one side of the fret board, which resilient strap runs downward along the side-support member, thence along the side of the fret board, thence underneath the neck of the musical instrument, thence up the opposite side of the fret board to accomodate (e) a tension-adjusting eyelet of the resilient strap to the distal end of the pin, (f) a plurality of identical eccentrically apertured flattened elastic discs along the pin, the pin being supported above the strings by cooperation of the side-support member with the elastic clamping discs, which elastic clamping discs are individually rotatable about the pin and individually spaceable along the axis of the pin by the musician's fingering to overcome the friction established by the slightly larger diameter of the cross-section of the pin relative to the apertures of the elastic clamping discs;

whereby any single string or any selected combination of strings at any accessable fret may be clamped and unclamped by the musician, thereby increasing the range of musical chords playable on the musical instrument.

* * * * *